US009897088B2

(12) United States Patent
Su et al.

(10) Patent No.: US 9,897,088 B2
(45) Date of Patent: Feb. 20, 2018

(54) SCROLL COMPRESSOR WITH BACK PRESSURE CHAMBER HAVING LEAKAGE CHANNEL

(71) Applicant: EMERSON CLIMATE TECHNOLOGIES (SUZHOU) CO., LTD., Jiangsu (CN)

(72) Inventors: Xiaogeng Su, Jiangsu (CN); Yinbo Zhu, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 174 days.

(21) Appl. No.: 14/761,453

(22) PCT Filed: Oct. 30, 2013

(86) PCT No.: PCT/CN2013/086182
§ 371 (c)(1),
(2) Date: Jul. 16, 2015

(87) PCT Pub. No.: WO2014/110930
PCT Pub. Date: Jul. 24, 2014

(65) Prior Publication Data

US 2015/0361980 A1 Dec. 17, 2015

(30) Foreign Application Priority Data

Jan. 21, 2013 (CN) ..... 2013 1 0020858
Jan. 21, 2013 (CN) ..... 2013 2 0037041 U

(51) Int. Cl.
*F03C 2/00* (2006.01)
*F03C 4/00* (2006.01)
(Continued)

(52) U.S. Cl.
CPC ..... *F04C 27/02* (2013.01); *F04C 14/26* (2013.01); *F04C 18/0215* (2013.01);
(Continued)

(58) Field of Classification Search
CPC ..... F04C 18/0215; F04C 18/0253; F04C 18/0261; F04C 23/008; F04C 27/00;
(Continued)

(56) References Cited

U.S. PATENT DOCUMENTS 5,156,539 A 10/1992 Anderson et al.
7,074,013 B2 1/1994 Seibel et al.
(Continued)

FOREIGN PATENT DOCUMENTS

CN 1060699 A 4/1992
CN 1028379 C 5/1995
(Continued)

OTHER PUBLICATIONS

Extended European Search Report regarding Application No. PCT/CN2013/086182 dated Sep. 13, 2016.
(Continued)

*Primary Examiner* — Theresa Trieu
(74) *Attorney, Agent, or Firm* — Harness, Dickey & Pierce, P.L.C.

(57) ABSTRACT

A scroll compressor (100) comprises an orbiting scroll component (160); a fixed scroll component (150); sealing components (PS1, PS2, PS3, PS4, PS5, PS6), wherein the sealing components match a concave part (158) on the orbiting scroll component (50) so as to form a back pressure chamber (BC) together, and the sealing components are constructed to separate the back pressure chamber from a high-pressure side and a low-pressure side in the scroll compressor (100); and a leakage path (L), wherein the leakage path (L) is constructed to allow fluid in the back pressure chamber (BC) to leak.

18 Claims, 9 Drawing Sheets

(51) Int. Cl.

| | |
|---|---|
| ***F04C 2/00*** | (2006.01) |
| ***F04C 18/00*** | (2006.01) |
| ***F04C 27/02*** | (2006.01) |
| ***F04C 14/26*** | (2006.01) |
| ***F04C 23/00*** | (2006.01) |
| ***F04C 27/00*** | (2006.01) |
| ***F04C 18/02*** | (2006.01) |
| *F04C 29/12* | (2006.01) |

(52) U.S. Cl.
CPC ..... *F04C 18/0253* (2013.01); *F04C 23/008* (2013.01); *F04C 27/005* (2013.01); *F04C 27/008* (2013.01); *F04C 29/12* (2013.01); *F04C 29/126* (2013.01)

(58) Field of Classification Search
CPC ..... F04C 27/005; F04C 27/008; F04C 27/02; F04C 28/26; F04C 14/26
USPC .... 418/15, 55.1–55.6, 57, 180, 270, DIG. 1; 417/310, 299
See application file for complete search history.

(56) References Cited

U.S. PATENT DOCUMENTS

| | | | |
|---|---|---|---|
| RE35,216 | E | 4/1996 | Anderson et al. |
| 5,588,820 | A | 12/1996 | Hill et al. |
| 5,611,674 | A | 3/1997 | Bass et al. |
| 5,741,120 | A | 4/1998 | Bass et al. |
| 6,047,557 | A | 4/2000 | Pham et al. |
| 6,086,335 | A | 7/2000 | Bass et al. |
| 6,206,652 | B1 | 3/2001 | Caillat |
| 6,393,852 | B2 | 5/2002 | Pham et al. |
| 6,408,635 | B1 | 6/2002 | Pham et al. |
| 6,419,457 | B1 | 7/2002 | Seibel et al. |
| 6,438,974 | B1 | 8/2002 | Pham et al. |
| 6,449,972 | B2 | 9/2002 | Pham et al. |
| 6,467,280 | B2 | 10/2002 | Pham et al. |
| 6,499,305 | B2 | 12/2002 | Pham et al. |
| 6,662,578 | B2 | 12/2003 | Pham et al. |
| 6,662,583 | B2 | 12/2003 | Pham et al. |
| 6,679,072 | B2 | 1/2004 | Pham et al. |
| 6,679,683 | B2 | 1/2004 | Seibel et al. |
| 6,913,448 | B2 | 7/2005 | Liang et al. |
| RE40,400 | E | 6/2008 | Bass et al. |
| 7,389,649 | B2 | 6/2008 | Pham et al. |
| 7,419,365 | B2 | 9/2008 | Pham et al. |
| RE40,554 | E | 10/2008 | Bass et al. |
| RE40,830 | E | 7/2009 | Caillat |
| 7,654,098 | B2 | 2/2010 | Pham et al. |
| RE42,006 | E | 12/2010 | Pham et al. |
| 8,313,318 | B2 | 11/2012 | Stover et al. |
| 8,475,140 | B2 | 7/2013 | Seibel et al. |
| 8,517,704 | B2 | 8/2013 | Stover et al. |
| 8,529,232 | B2 | 9/2013 | Stover et al. |
| RE44,636 | E | 12/2013 | Caillat |
| 2001/0002239 | A1 | 5/2001 | Pham et al. |
| 2001/0045097 | A1 | 11/2001 | Pham et al. |
| 2001/0049942 | A1 | 12/2001 | Pham et al. |
| 2002/0178737 | A1 | 12/2002 | Pham et al. |
| 2003/0012659 | A1 | 1/2003 | Seibel et al. |
| 2003/0084672 | A1 | 5/2003 | Pham et al. |
| 2003/0089119 | A1 | 5/2003 | Pham et al. |
| 2003/0094004 | A1 | 5/2003 | Pham et al. |
| 2004/0081562 | A1 | 4/2004 | Seibel et al. |
| 2004/0123612 | A1 | 7/2004 | Pham et al. |
| 2005/0142017 | A1 | 6/2005 | Liang et al. |
| 2006/0204379 | A1 | 9/2006 | Seibel et al. |
| 2006/0204380 | A1 | 9/2006 | Seibel et al. |
| 2006/0288715 | A1 | 12/2006 | Pham et al. |
| 2007/0022771 | A1 | 2/2007 | Pham et al. |
| 2007/0269326 | A1 | 11/2007 | Seibel et al. |
| 2009/0297378 | A1 | 12/2009 | Stover et al. |
| 2010/0135836 | A1 | 6/2010 | Stover et al. |
| 2011/0033328 | A1 | 2/2011 | Stover et al. |
| 2012/0107163 | A1 | 5/2012 | Monnier et al. |
| 2012/0148433 | A1 | 6/2012 | Liang et al. |
| 2012/0195781 | A1 | 8/2012 | Stover et al. |

FOREIGN PATENT DOCUMENTS

| | | | |
|---|---|---|---|
| CN | 1113547 | | 12/1995 |
| CN | 1137614 | A | 12/1996 |
| CN | 1349053 | A | 5/2002 |
| CN | 1475673 | A | 2/2004 |
| CN | 101413504 | A | 4/2009 |
| CN | 102089524 | A | 6/2011 |
| CN | 202228358 | | 5/2012 |
| CN | 203051114 | | 7/2013 |
| EP | 0479421 | A1 | 4/1992 |
| EP | 0681105 | A2 | 11/1995 |
| JP | 2001-027188 | | 1/2001 |
| JP | 2010163877 | A | 7/2010 |
| WO | WO-2012058455 | A1 | 5/2012 |

OTHER PUBLICATIONS

International Search Report for PCT/CN2013/086182, ISA/CN, dated Feb. 13, 2014.

First Chinese Office Action regarding Application No. 201310020858.X dated Sep. 25, 2015. English translation provided by Unitalen Attorneys at Law.

Written Opinion of the ISA/CN for PCT/CN2013/086182 dated Feb. 13, 2014. English translation provided by Unitalen Attorneys at Law.

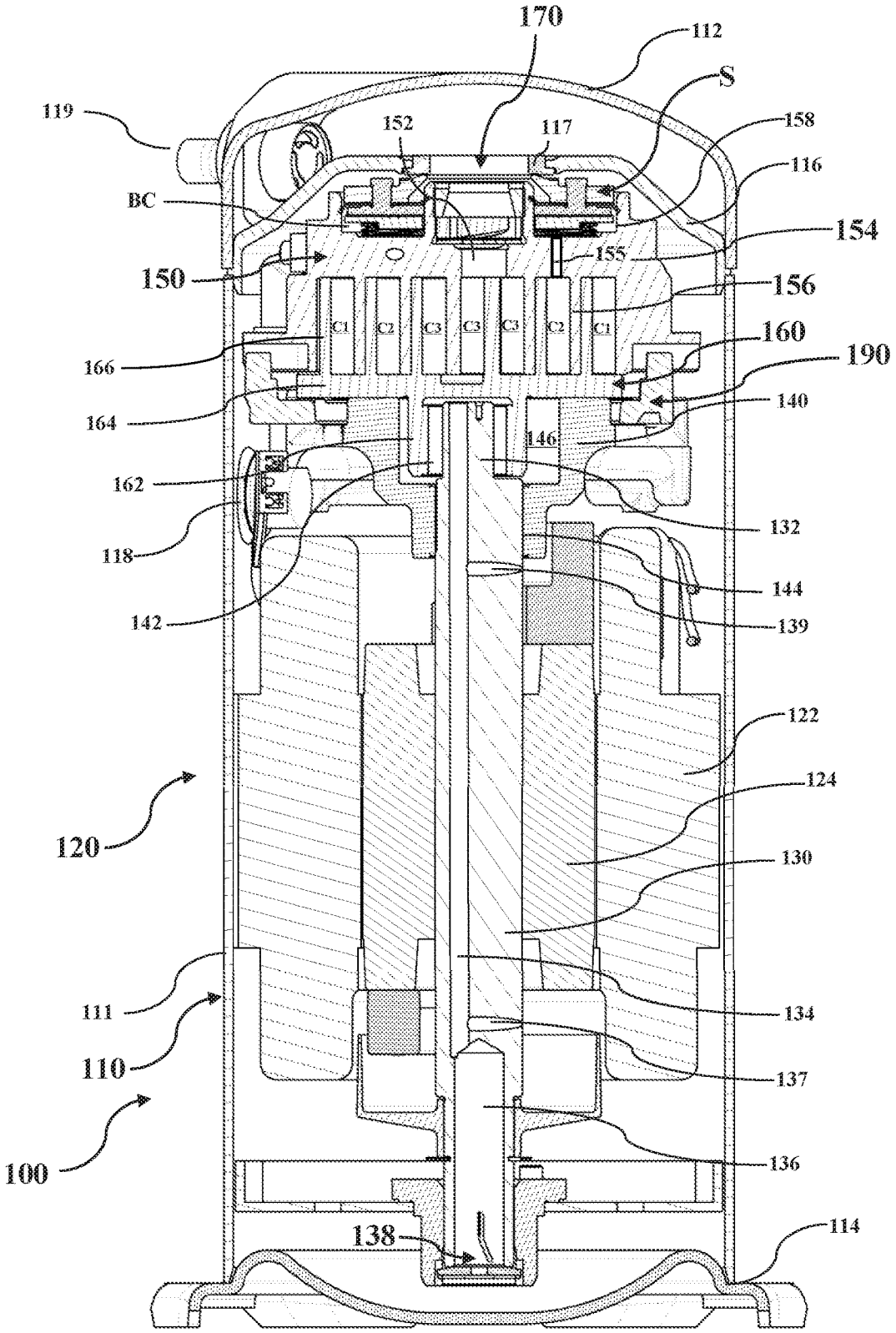
Fig. 1A -- PRIOR ART

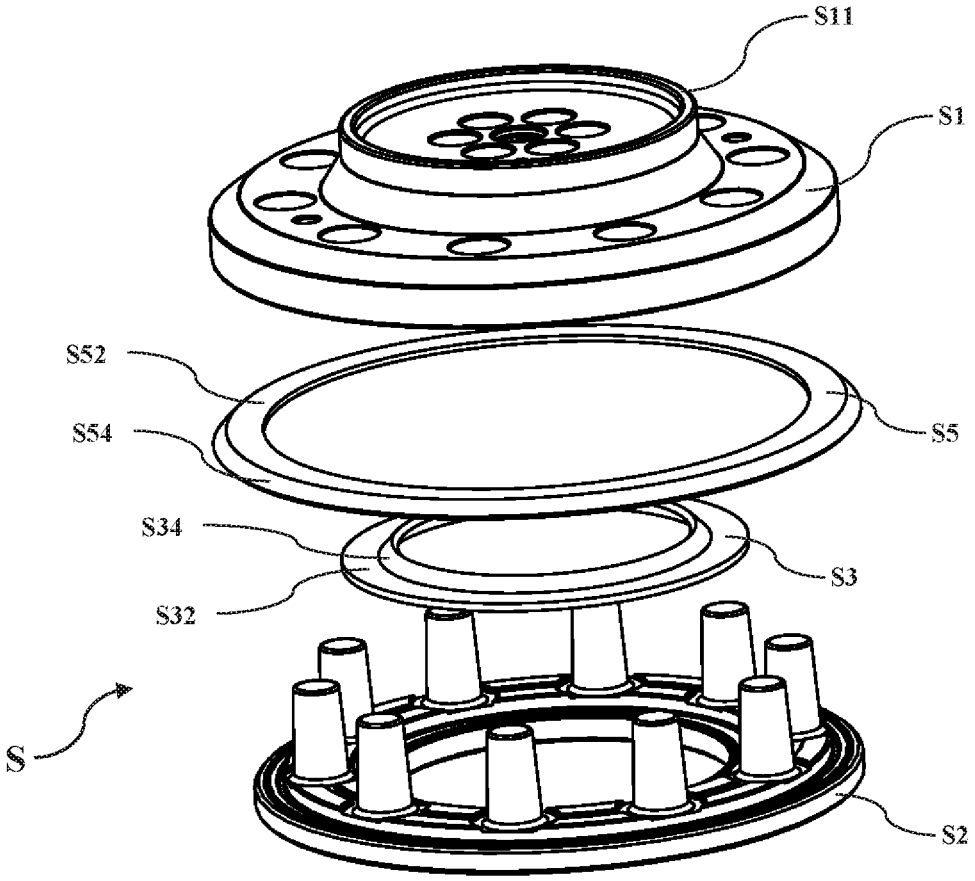
Fig. 1B -- PRIOR ART

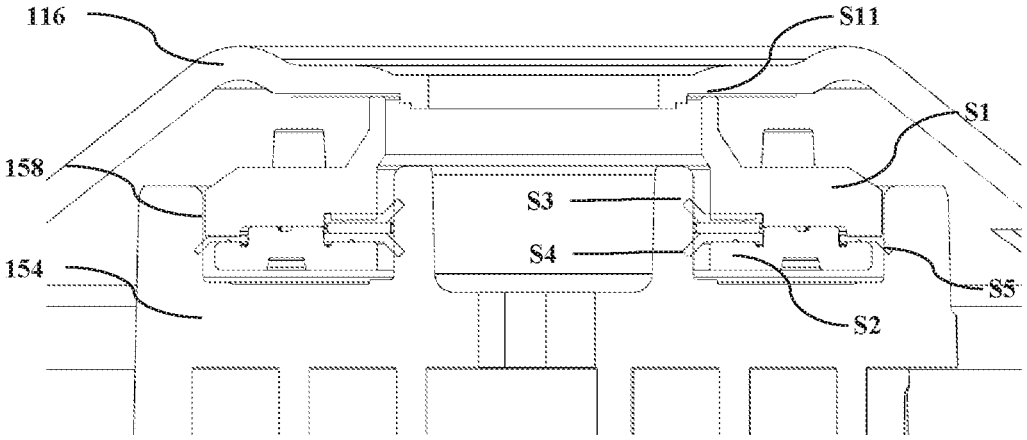
Fig. 2A -- PRIOR ART
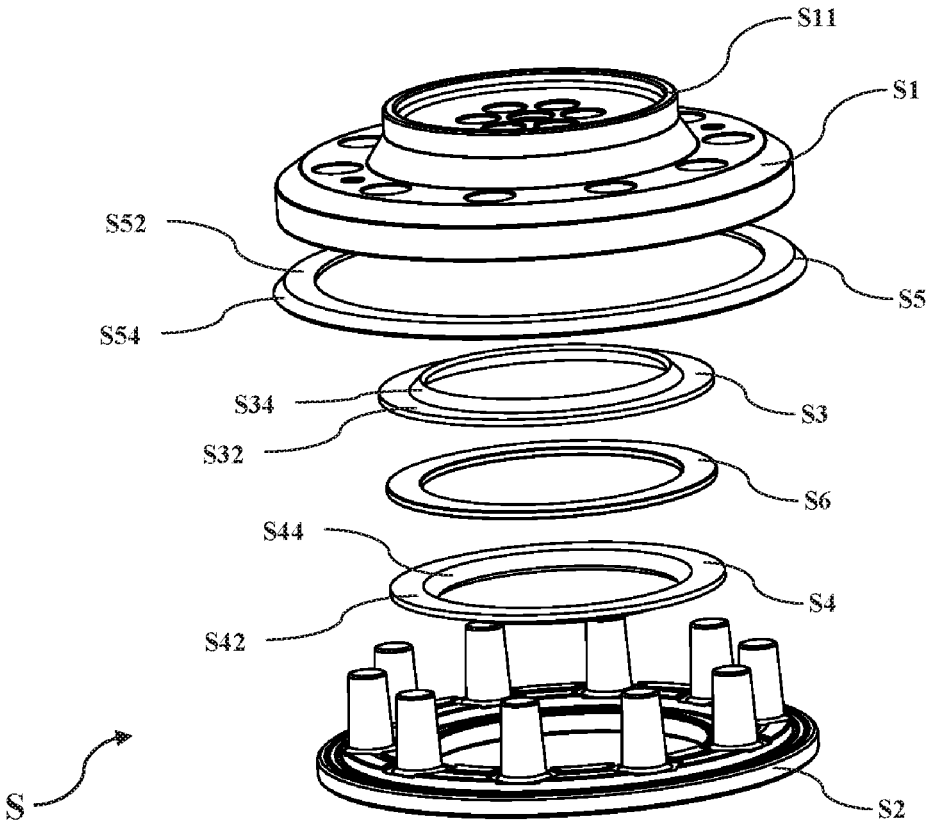
Fig. 2B -- PRIOR ART

SCROLL COMPRESSOR WITH BACK PRESSURE CHAMBER HAVING LEAKAGE CHANNEL

This application is the national phase of International Application No. PCT/CN2013/086182, titled "SCROLL COMPRESSOR" and filed on Oct. 30, 2013, which claims priority from Chinese Patent Application No. 201310020858.X titled "SCROLL COMPRESSOR" and filed with the Chinese State Intellectual Property Office on Jan. 21, 2013, and Chinese Patent Application No. 201320037041.9 titled "SCROLL COMPRESSOR" and filed with the Chinese State Intellectual Property Office on Jan. 21, 2013. The entire disclosures of the Chinese Patent Applications are incorporated herein by reference.

FIELD

The present application relates to a scroll compressor.

BACKGROUND

The contents in this section only provide background information relating to the present disclosures which does not necessarily constitute the prior art.

A scroll compressor generally includes a compression mechanism constituted by a non-orbiting scroll component and an orbiting scroll component. Typically, an end plate of the non-orbiting scroll component is formed thereon with a concave portion and a seal assembly is provided in the concave portion. The concave portion is in fluid communication with one of a series of compression chambers formed between the non-orbiting scroll component and the orbiting scroll component. The seal assembly is fitted in the concave portion to form a back pressure chamber which provides back pressure to the non-orbiting scroll component. In the cases that the scroll compressor works in different working conditions, sealing requirements for the seal assembly are also different. Therefore, there remains room for further improvement in the seal assembly.

SUMMARY

A scroll compressor is provided according to one aspect of the embodiments of the present application. The scroll compressor includes an orbiting scroll component, a non-orbiting scroll component, a seal assembly and a leakage channel. The orbiting scroll component includes an orbiting scroll end plate, and a spiral orbiting scroll vane formed at one side of the orbiting scroll end plate. The non-orbiting scroll component includes a non-orbiting scroll end plate, a spiral non-orbiting scroll vane formed at one side of the non-orbiting scroll end plate, and a concave portion formed at the other side of the non-orbiting scroll end plate. The concave portion is in fluid communication with one of a series of compression chambers formed between the orbiting scroll vane and the non-orbiting scroll vane via a medium pressure channel. The seal assembly is fitted with the concave portion to jointly form a back pressure chamber, and is configured to separate the back pressure chamber from a high-pressure side and a low-pressure side in the scroll compressor. The leakage channel is configured to allow fluid in the back pressure chamber to leak.

BRIEF DESCRIPTION OF THE DRAWINGS

Features and advantages of one or more embodiments of the present application can be understood more readily from the following description made with reference to drawings in which:

FIG. 1A is a longitudinal sectional view of a conventional scroll compressor;

FIG. 1B is an exploded view of a single-layer seal assembly shown in FIG. 1A;

FIG. 2A is a sectional view of a double-layer seal assembly;

FIG. 2B is an exploded view of the double-layer seal assembly shown in FIG. 2A;

DETAILED DESCRIPTION

Figure 3A:
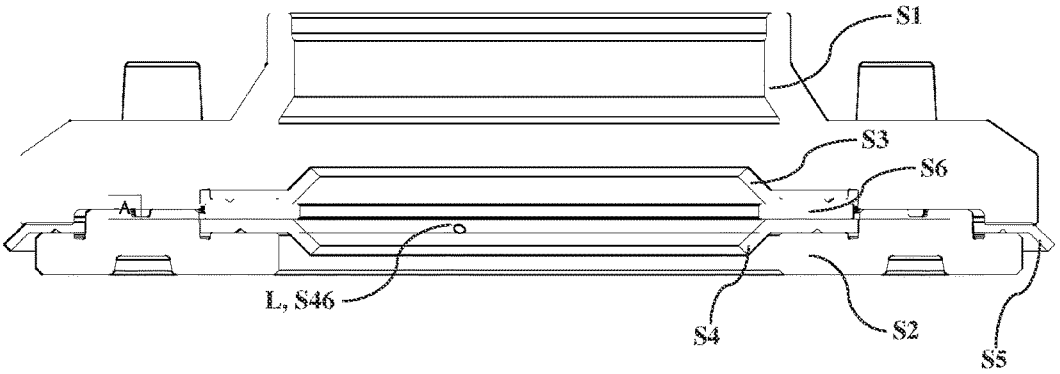
FIG. 3A is a sectional view of a seal assembly according to a first embodiment of the present application.

The following description of various embodiments of the application is only illustrative rather than a limitation to the present application and use or usage thereof. Throughout the figures, the like reference signs are used to indicate the like elements and thus the description of the like elements will not be repeated.

First, the general configuration and operation principle of the scroll compressor are described with reference to FIG. 1A. As shown in FIG. 1A, the scroll compressor 100 (sometimes referred to as compressor hereinafter) generally includes a housing 110. The housing 110 may include a substantially cylindrical body 111, a top cover 112 arranged at one end of the body 111, a bottom cover 114 provided at the other end of the body 111, and a separator 116 arranged between the top cover 112 and the body 111 to separate an inner space of the compressor into a high-pressure side and a low-pressure side. The space between the separator 116 and the top cover 112 constitutes the high-pressure side, and the space among the separator 116, the body 111 and the bottom cover 114 constitutes the low-pressure side. An intake connector 118 configured to suck fluid is provided at the low-pressure side, and an outlet connector 119 configured to discharge the compressed fluid is provided at the high-pressure side. A motor 120 constituted by a stator 122 and a rotor 124 is arranged in the housing 110. A drive shaft 130 is arranged in the rotor 124 to drive a compression mechanism constituted by the non-orbiting scroll component 150 and the orbiting scroll component 160. The orbiting scroll component 160 includes an end plate 164, a hub 162 formed at one side of the end plate, and a spiral vane 166 formed at the other side of the end plate. The non-orbiting scroll component 150 includes an end plate 154, a spiral vane 156 formed at one side of the end plate, and a concave portion 158 formed at the other side of the end plate. A discharge port 152 is formed at a substantially center position of the end plate. The space around the discharge port 152 also constitutes a high-pressure side. A series of compression chambers C1, C2 and C3 with the volume gradually decreased from the radially outer side to the radially inner side are formed between the spiral vane 156 of the non-orbiting scroll 150 and the spiral vane 166 of the orbiting scroll 160. The radially outermost compression chamber C1 is at an intake pressure, and the radially innermost compression chamber C3 is at a discharge pressure. The compression chamber C2 in the middle is at a pressure between the intake pressure and the discharge pressure, and thus is also referred to as a medium pressure chamber.

The orbiting scroll component 160 is supported at one side by an upper portion (i.e. a support portion) of a main bearing housing 140, and one end of the drive shaft 130 is supported by a main bearing 144 arranged in the main bearing housing 140. One end of the drive shaft 130 is provided with an eccentric crank pin 132, and an unloading liner 142 is provided between the eccentric crank pin 132 and the hub 162 of the orbiting scroll component 160. Driven by a motor 120, the orbiting scroll component 160 orbits relative to the non-orbiting scroll component 150 (i.e., the central axis of the orbiting scroll component 160 rotates about the central axis of the non-orbiting scroll component 150, but the orbiting scroll component 160 itself may not rotate about its own central axis) to achieve compression of the fluid. The orbiting is achieved by an Oldham ring 190 arranged between the non-orbiting scroll component 150 and the orbiting scroll component 160. The fluid compressed by the non-orbiting scroll component 150 and the orbiting scroll component 160 is discharged to the high-pressure side via the discharge port 152. In order to prevent the fluid at the high-pressure side from back flowing to the low-pressure side via the discharge port 152 in a particular case, a one-way valve or a discharge valve 170 may be provided at the discharge port 152.

In order to achieve compression of the fluid, an effective sealing is required between the non-orbiting scroll component 150 and the orbiting scroll component 160.

On the one hand, axial sealing is required between a top end of the spiral vane 156 of the non-orbiting scroll component 150 and the end plate 164 of the orbiting scroll component 160 and between a top end of the spiral vane 166 of the orbiting scroll component 160 and the end plate 154 of the non-orbiting scroll component 150. Typically, a seal assembly S is provided in the concave portion 158 of the non-orbiting scroll component 150. That is, the seal assembly S is arranged between the separator 116 and the non-orbiting scroll component 150. The concave portion 158 is in fluid communication with one of the series of compression chambers C1, C2, C3 via a through hole 155 (also referred to as a medium pressure channel) formed in the non-orbiting scroll end plate 154. Preferably, the concave portion 158 is in fluid communication with the compression chamber C2 in the middle via the through hole 155. Thus, the seal assembly S is fitted with the concave portion 158 to jointly form a back pressure chamber BC which provides back pressure to the orbiting scroll component 150. The axial displacement of the seal assembly S is limited by the separator 116. Since the orbiting scroll component 160 is supported at one side by the support portion of the main bearing housing 140, the non-orbiting scroll component 150 and the orbiting scroll component 160 may be effectively pressed together by the pressure in the back pressure chamber BC. In the case that the pressures in various compression chambers exceed a set value, the resultant force generated by the pressures in these compression chambers will exceed a pressing downward force provided in the back pressure chamber BC, thus allowing the non-orbiting scroll component 150 to move upwards. At this time, the fluid in the compression chambers will leak to the low-pressure side via a gap between the top end of the spiral vane 156 of the non-orbiting scroll component 150 and the end plate 164 of the orbiting scroll component 160 and a gap between the top end of the spiral vane 166 of the orbiting scroll component 160 and the end plate 154 of the non-orbiting scroll component 150 to achieve unloading, thereby providing an axial compliance to the scroll compressor.

On the other hand, radial sealing is further required between a side surface of the spiral vane 156 of the non-orbiting scroll component 150 and a side surface of the spiral vane 166 of the orbiting scroll component 160. The radial sealing between the both is typically achieved by means of a centrifugal force of the orbiting scroll component 160 during operation, and a driving force provided by the drive shaft 130. Specifically, in operation, driven by the motor 120, the orbiting scroll component 160 will orbit relative to the non-orbiting scroll component 150, so that the orbiting scroll component 160 will generate a centrifugal force. Further, the eccentric crank pin 132 of the drive shaft 130 will also produce, during rotation, a driving force component to facilitate the radial sealing between the non-orbiting scroll component and orbiting scroll component. The spiral vane 166 of the orbiting scroll component 160 will abut against the spiral vane 156 of the non-orbiting scroll component 150 by means of the above centrifugal force and driving force component, thus achieving the radial sealing between the spiral vane 166 of the orbiting scroll component 160 and the spiral vane 156 of the non-orbiting scroll component 150. When an incompressible matter (such as solid impurities, lubricant and liquid refrigerant) enters into the compression chamber and is stuck between the spiral vane 156 and the spiral vane 166, the spiral vane 156 and the spiral vane 166 can apart from each other temporarily in the radial direction so as to allow the foreign matters to pass therethrough, thus preventing the spiral vane 156 or the spiral vane 166 from being damaged. The capability of moving apart radially provides a radial compliance to the scroll compressor, and improves the reliability of the compressor.

The lubrication of the components of the compressor will be described hereinafter. In the example of a vertical scroll compressor shown in FIG. 1, lubricant is stored at the bottom of the compressor housing. Accordingly, a channel is formed in the drive shaft 130 and extends substantially in an axial direction of the drive shaft 130, including a central hole 136 formed at a lower end of the drive shaft 130 and an eccentric hole 134 extending upwards to an end face of the eccentric crank pin 132 from the central hole 136. An end portion of the central hole 136 is submerged in the lubricant in the bottom of the compressor housing or is supplied with lubricant in other manners. In one example, a lubricant supply device may be provided in the central hole 136 or near the central hole 136, for example, an oil pump or an oil fork 138 as shown in FIG. 1. In the operation of the compressor, one end of the central hole 136 is supplied with lubricant by the lubricant supply device, and the lubricant entered into the central hole 136 is pumped or thrown into the eccentric hole 134 by the centrifugal force during rotation of the drive shaft 130, and flows upwards along the eccentric hole 134 till it reaches the end face of the eccentric crank pin 132. The lubricant discharged from the end face of the eccentric crank pin 132 flows downwards through a gap between the unloading liner 142 and the eccentric crank pin 132 and a gap between the unloading liner 142 and the hub 162 into the concave portion 146 of the main bearing housing 140. A part of lubricant gathered in the concave portion 146 flows downwards through the main bearing 144, and a part of lubricant is agitated by the hub 162 to move upwards to reach a lower side of the end plate 164 of the orbiting scroll component 160 and spread over thrust surfaces of the orbiting scroll component 160 and the main bearing housing 140 as the orbiting scroll component 160 orbits. In order to improve the lubrication and cooling effect of the rotor 124 of the motor, a radial hole 139 may be provided in the drive shaft 130 to directly supply the lubricant from the eccentric hole 134 to the rotor 124. In addition, a radial hole 137 may further be provided in the drive shaft 130, to directly supply the lubricant to a lower bearing which supports a lower end of the drive shaft 130. In the operation of the compressor, the lubricant supplied to the various movable components in the compressor is thrown or splashes to form liquid drops or mist. These lubricant drops or mist will be mixed with the working fluid (or refrigerant) sucked from the intake connector 118. Subsequently, the working fluid mixed with the lubricant drops is sucked into the compression chambers between the non-orbiting scroll component 150 and the orbiting scroll component 160 to realize the lubricating, sealing and cooling of the interior of these scroll components. This kind of lubrication between the orbiting scroll component and the non-orbiting scroll component is commonly referred to as mist lubrication.

The configuration and function of the seal assembly S is further described in detail hereinafter. As shown in FIG. 1B, the seal assembly S may include an upper plate S1, a lower plate S2, and a first seal member S3 and a third seal member S5 which are arranged between the upper plate S1 and the lower plate S2. The shape of the seal assembly S substantially corresponds to the shape of the concave portion BC, such that the first seal member S3 may abut against a radial inner side wall of the concave portion 158 to achieve sealing, and the third seal member S5 may abut against a radial outer side wall of the concave portion 158 to achieve sealing. In addition, an upper end S11 of the upper plate S1 may abut against the separator 116 or abut against a lining ring 117 arranged on the separator 116 to achieve sealing. More specifically, the first seal member S3 is configured to prevent the fluid from flowing from the high-pressure side to the back pressure chamber BC, however, allow the fluid to flow from the back pressure chamber BC to the high-pressure side. For example, the first seal member S3 may include a substantially annular body S32, and a seal lip S34 extending away from the non-orbiting scroll end plate from the body S32 and abutting against the radial inner side wall of the concave portion 158. The body S32 is sandwiched between the upper plate S1 and the lower plate S2. Similarly, the third seal member S5 is configured to prevent the fluid from flowing from the back pressure chamber BC to the low-pressure side. For example, the third seal member S5 may include a substantially annular body S52 and a seal lip S54 extending towards the non-orbiting scroll end plate from the body S52 and abutting against the radial outer side wall of the concave portion 158. The body S52 is sandwiched between the upper plate S1 and the lower plate S2.

The seal assembly S achieves sealing in a compressor in the following manners: 1) the upper end S11 of the upper plate S1 abuts against the lining ring 117 in the separator 116 to achieve the separation of the high-pressure side from the low-pressure side; 2) the first seal member S3 abuts against the radial inner side wall of the concave portion 158 to achieve the separation of the high-pressure side from the back pressure chamber BC; 3) the third seal member S5 abuts against the radial outer side wall of the concave portion 158 to achieve the separation of the back pressure chamber BC from the low-pressure side.

If the above seal assembly S (also referred to as a single-layer seal assembly) is applied, in the case that the compressor is started with liquid, the scroll components compress the liquid, and the pressure in the back pressure chamber BC is much higher than the discharge pressure (the pressure in the high-pressure side), the first seal member S3 allows the fluid in the back pressure chamber to leak to the high-pressure side, thus can just relief this part of surged pressure, which improves the reliability of the compressor. However, in the case that the compressor is in a working condition of a low pressure ratio, if the pressure in the back pressure chamber BC is higher than that on the high-pressure side, the first seal member S3 allows the pressure in the back pressure chamber to leak to the high-pressure side, thus may cause the improper engagement between the orbiting scroll component and the non-orbiting scroll component, and thus the noise, and reduced refrigerating capacity and the like.

FIGS. 2A and 2B illustrate a double-layer seal assembly. More specifically, in addition to the components shown in FIG. 1B, the seal assembly S shown in FIGS. 2A and 2B further includes a second seal member S4 and an intermediate plate S6 arranged between the first seal member S3 and the second seal member S4. The second seal member S4 is configured to prevent the fluid from flowing from the back pressure chamber BC to the high-pressure side, however, allow the fluid to flow from the high-pressure side to the back pressure chamber BC. For example, the second seal member S4 may include a substantially annular body S42 and a seal lip S44 extending from the body S42 towards the non-orbiting scroll end plate and abutting against the radial inner side wall of the concave portion 158. The body S42 is sandwiched between the intermediate plate S6 and the lower plate S2. The structure and function of other members of the double-layer seal assembly are similar to those of the single-layer seal assembly shown in FIG. 1B.

If the double-layer seal assembly S shown in FIGS. 2A and 2B is applied, in the case that the compressor is in a working condition of a low pressure ratio, even if the pressure in the back pressure chamber BC is higher than that in the high-pressure side, the second seal member S4 does not allow the pressure in the back pressure chamber to leak to the high-pressure side, result in the good engagement between the orbiting scroll component and the non-orbiting scroll component. However, in the case that the compressor is started with liquid, since the second seal member S4 does not allow the fluid in the back pressure chamber to leak to the high-pressure side, the pressure in the back pressure chamber BC is far higher than the pressure desired, resulting in increasing of an axial force between the orbiting scroll component and the non-orbiting scroll component, which influences the reliability and service life of the compressor. It is to be noted that, the constructions of the above single-layer seal assembly and double-layer seal assembly are described more detail in China Invention Patent CN1028379C, the entire disclosure of which is incorporated herein by reference.

Thus, the above sealing construction has still room for improvement to achieve stable and reliable operation of the compressor in various operation conditions.

The inventor proposes to provide a leakage channel allowing the fluid in the back pressure chamber to leak outwards to address the above issues. Theoretically, the leakage channel may be configured to allow the fluid in the back pressure chamber to leak to the high-pressure side or the low-pressure side. However, considering the overall working efficiency of the compressor, preferably, the leakage channel is configured to allow the fluid in the back pressure chamber to leak to the high-pressure side. Various embodiment of the construction of the leakage channel will be described with reference to FIGS. 3A to 8 below.

Figure 3B:
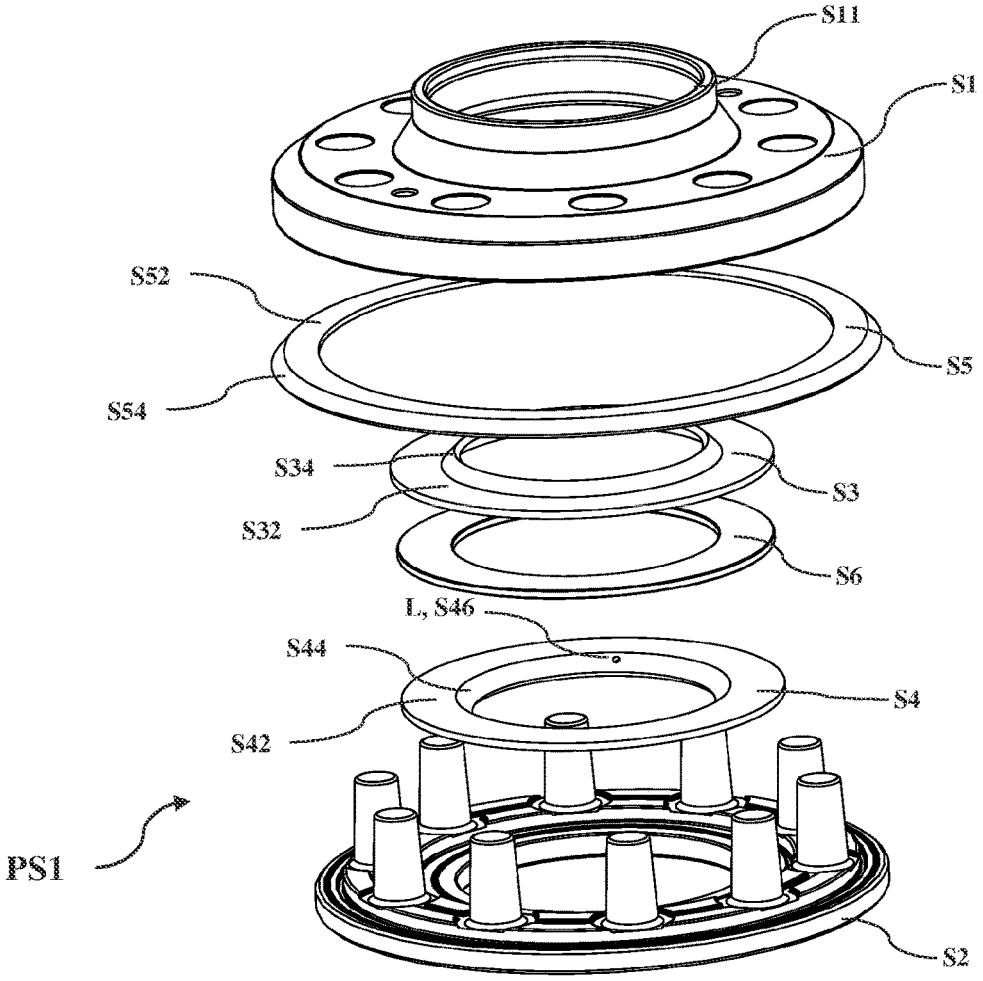
FIG. 3B is an exploded view of the seal assembly shown in FIG. 3A.

A seal assembly PS1 according to a first embodiment of the present application is described in detail hereinafter with reference to FIGS. 3A and 3B. The basic construction of the seal assembly PS1 shown in FIGS. 3A and 3B are substantially the same as that shown in FIGS. 2A and 2B. Specifically, the seal assembly PS1 according to the first embodiment of the present application may include an upper plate S1, a lower plate S2 and an intermediate plate S6. A first seal member S3 and a third seal member S5 are arranged between the upper plate S1 and the intermediate plate S6. A second seal member S4 is arranged between the intermediate plate S6 and the lower plate S2. The first seal member S3 and the second seal member S4 may abut against a radial inner side wall of the concave portion 158 to achieve sealing, and the third seal member S5 may abut against a radial outer side wall of the concave portion 158 to achieve sealing. An upper end S11 of the upper plate S1 may abut against the separator 116 or a lining ring 117 arranged on the separator 116 to achieve sealing. More specifically, the first seal member S3 may be configured to prevent the fluid from flowing from the high-pressure side to the back pressure chamber BC, however, allow the fluid to flow from the back pressure chamber BC to the high-pressure side. For example, the first seal member S3 may include a substantially annular body S32, and a seal lip S34 extending away from the non-orbiting scroll end plate from the body S32 and abutting against the radial inner side wall of the concave portion 158. The second seal member S4 may be configured to prevent the fluid from flowing from the back pressure chamber BC to the high-pressure side, however, allow the fluid to flow from the high-pressure side to the back pressure chamber BC. For example, the second seal member S4 may include a substantially annular body S42 and a seal lip S44 extending towards the non-orbiting scroll end plate from the body S42 and abutting against the radial inner side wall of the concave portion 158. The third seal member S5 may be configured to prevent the fluid from flowing from the back pressure chamber BC to the low-pressure side. For example, the third seal member S5 may include a substantially annular body S52, and a seal lip S54 extending towards the non-orbiting scroll end plate from the body S52 and abutting against the radial outer side wall of the concave portion 158.

Similarly, the seal assembly PS1 achieves sealing in a compressor in the following manners: 1) the upper end S11 of the upper plate S1 abuts against the lining ring 117 on the separator 116 to achieve the separation of the high-pressure side from the low-pressure side; 2) the first seal member S3 and the second seal member S4 abut against the radial inner side wall of the concave portion 158 to achieve the separation of the high-pressure side from the back pressure chamber BC; 3) the third seal member S5 abuts against the radial outer side wall of the concave portion 158 to achieve the separation of the back pressure chamber BC from the low-pressure side.

In the first embodiment of the present application, a leakage channel L is formed in the seal assembly PS1. More specifically, the leakage channel L is formed in the second seal member S4, in particular formed in the seal lip S44 of the second seal member S4. For example, the leakage channel L may be a through hole S46 formed in the seal lip S44 of the second seal member S4.

The minimum cross-sectional area of the leakage channel L can be set as ½ to 3 times of the minimum cross-sectional area of the medium pressure channel 155 (in this case the cross-sectional area of the through hole S46). Preferably, the minimum cross-sectional area of the leakage channel L can be set to be smaller than the minimum cross-sectional area of the medium pressure channel 155. In particular, the minimum cross-sectional area of the leakage channel L can be set as 0.8 times to 1.2 times of the minimum cross-sectional area of the medium pressure channel 155. It is noted that, in this embodiment and the following other embodiments, if the leakage channel L has varied cross-sections, the minimum cross-sectional area of the leakage channel L will be a parameter to control fluid leakage amount of the leakage channel L. Similarly, the minimum cross-sectional area of the medium pressure channel 155 is a parameter to control the amount of fluid supplied through the medium pressure channel 155.

If the seal assembly PS1 according to a first embodiment of the present application is used, in the case that the compressor is started with liquid, since the leakage channel L in the second seal member S4 allows the fluid in the back pressure chamber to leak to the high-pressure side, thus may just relief this part of surged pressure, and improves reliability of the compressor. At the same time, in the case that the compressor is in a working condition of a low presser ratio, though the leakage channel L in the second seal member S4 will cause leakage of the fluid in the back pressure chamber BC, since the leakage amount via the leakage channel L is smaller than the supply amount via the medium pressure channel 155, the second seal member S4 cooperating with the first seal member S3 can still maintain sufficient back pressure in the back pressure chamber, result in the good engagement between the orbiting scroll component and the non-orbiting scroll component and the reduced noise caused by the engagement. In other working conditions, the seal assembly PS1 may work as the single-layer seal assembly shown in FIGS. 1A and 1B. In other words, according to the present application, the compressor may operate stably and reliably in various working conditions.

The first embodiment of the present application may be implemented only by drilling a small hole in the seal lip S44 of the second seal member S4 of the existing double-layer seal assembly. Thus, the constructions of other portions of the compressor are not required to be varied or modified, which greatly saves the overall manufacture cost of the compressor.

Figure 4A:
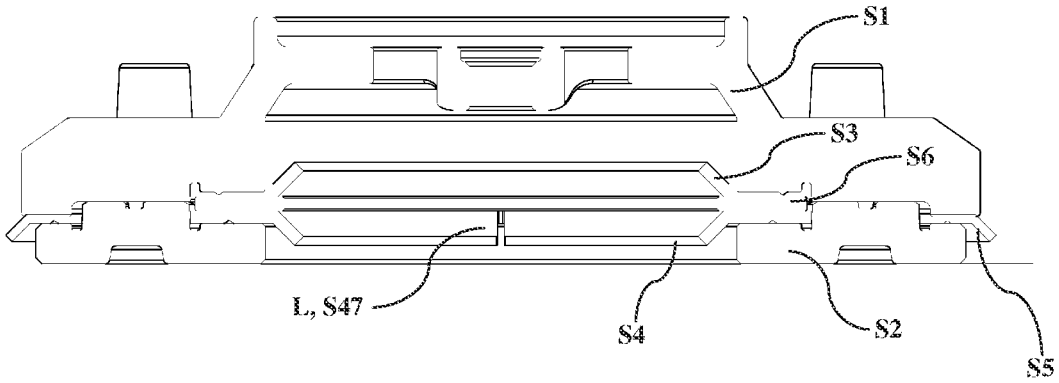
FIG. 4A is a sectional view of a seal assembly according to a second embodiment of the present application.
Figure 4B:
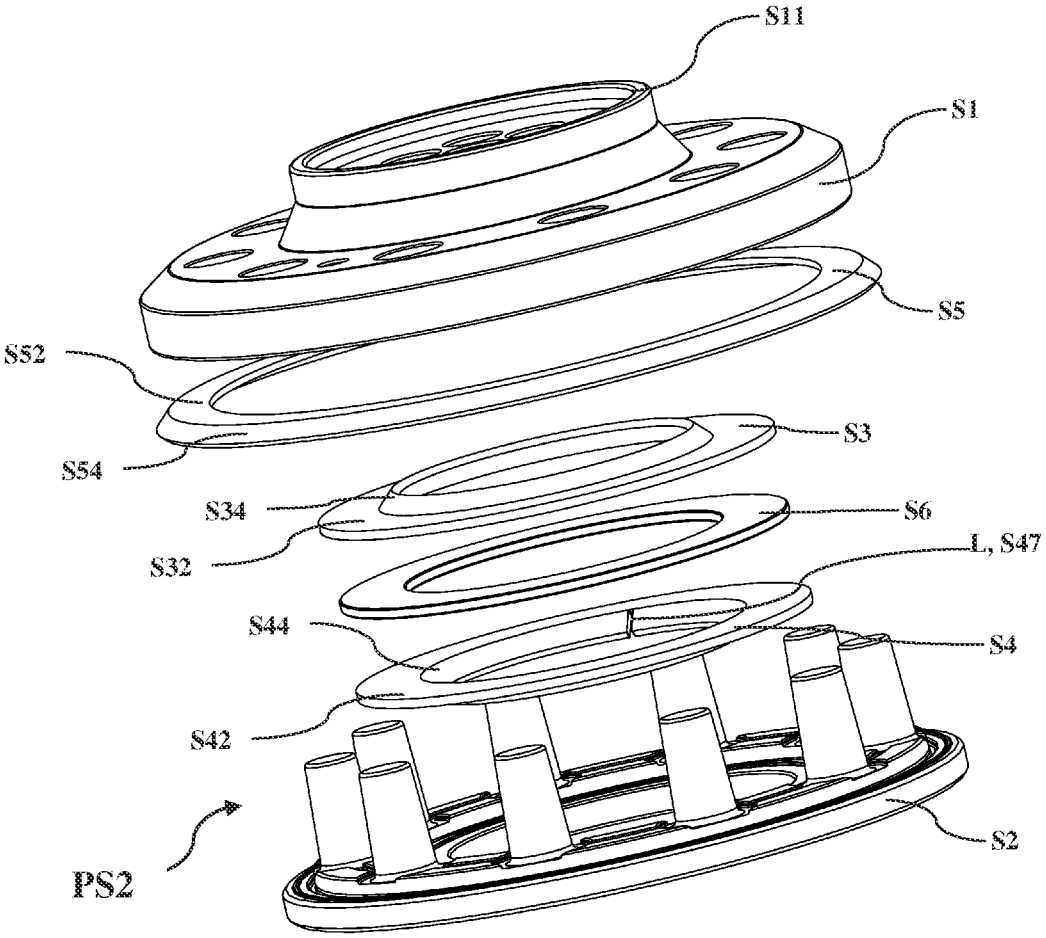
FIG. 4B is an exploded view of the seal assembly shown in FIG. 4A.

A seal assembly PS2 according to a second embodiment of the present application is described in detail hereinafter with reference to FIGS. 4A and 4B. The seal assembly PS2 according to the second embodiment is different from the seal assembly PS1 according to the first embodiment in that, the leakage channel L is a cutout S47 formed on an edge of the seal lip S44 of the second seal member S4. The seal assembly according to the second embodiment may achieve the similar effect as that of the first embodiment.

Figure 5A:
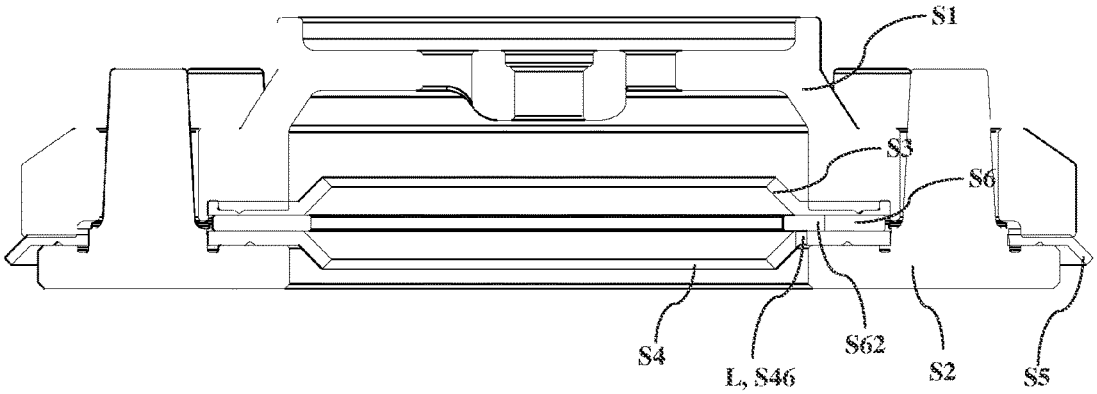
FIG. 5A is a sectional view of a seal assembly according to a third embodiment of the present application.
Figure 5B:
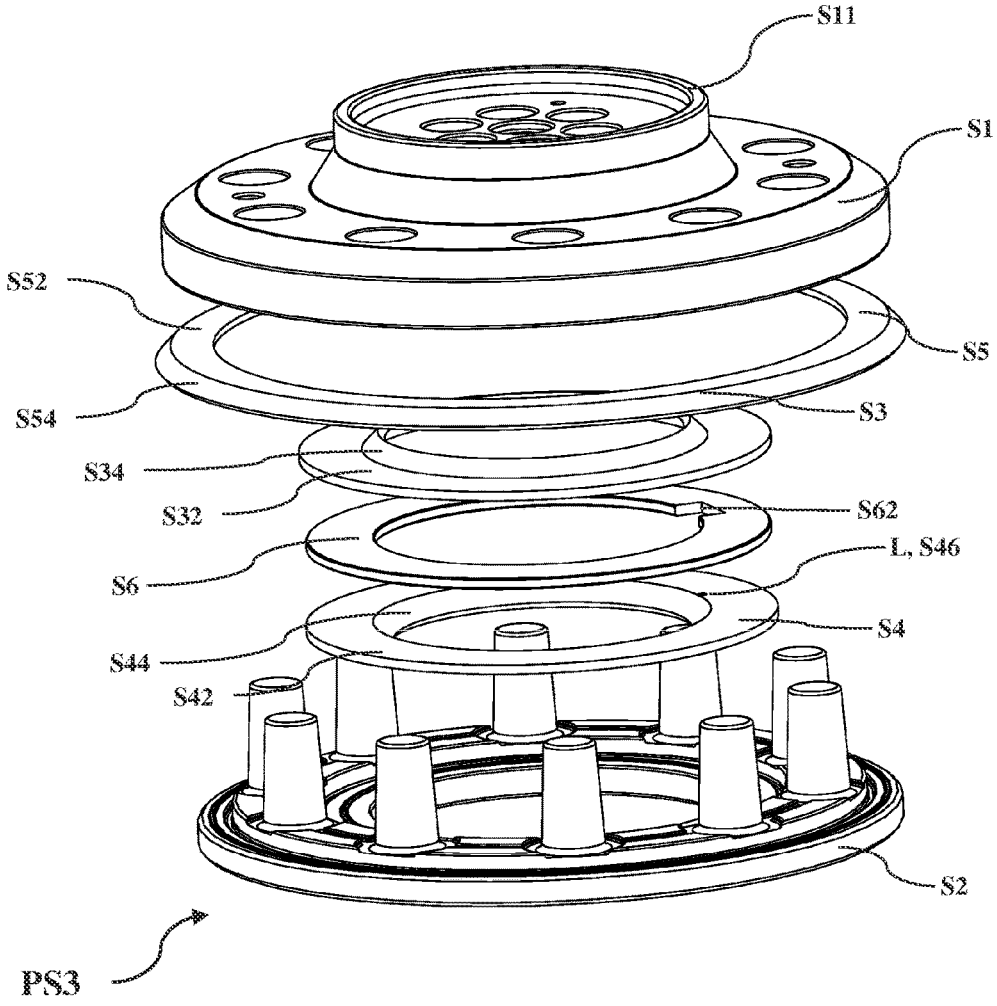
FIG. 5B is an exploded view of the seal assembly shown in FIG. 5A.

A seal assembly PS3 according to a third embodiment of the present application is described in detail hereinafter with reference to FIGS. 5A and 5B. The seal assembly PS3 according to the third embodiment is different from the seal assembly PS1 according to the first embodiment in that, the through hole S46 may be formed in the body S42 of the second seal member S4 or in the seal lip S44, and a cutout S62 is formed at a position in the intermediate plate S6 corresponding to the through hole S46. The seal assembly according to the third embodiment may achieve the similar effect as that of the first embodiment. In addition, the third embodiment may further facilitate the machining of the through hole S46.

Figure 6A:
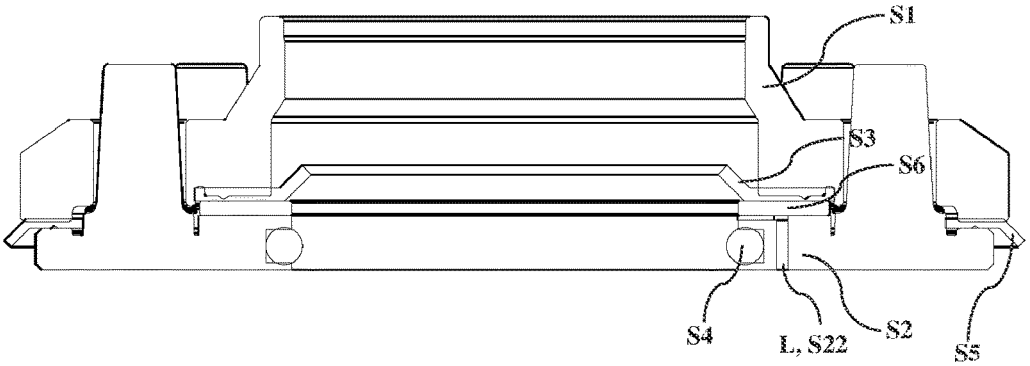
FIG. 6A is a sectional view of a seal assembly according to a fourth embodiment of the present application.
Figure 6B:
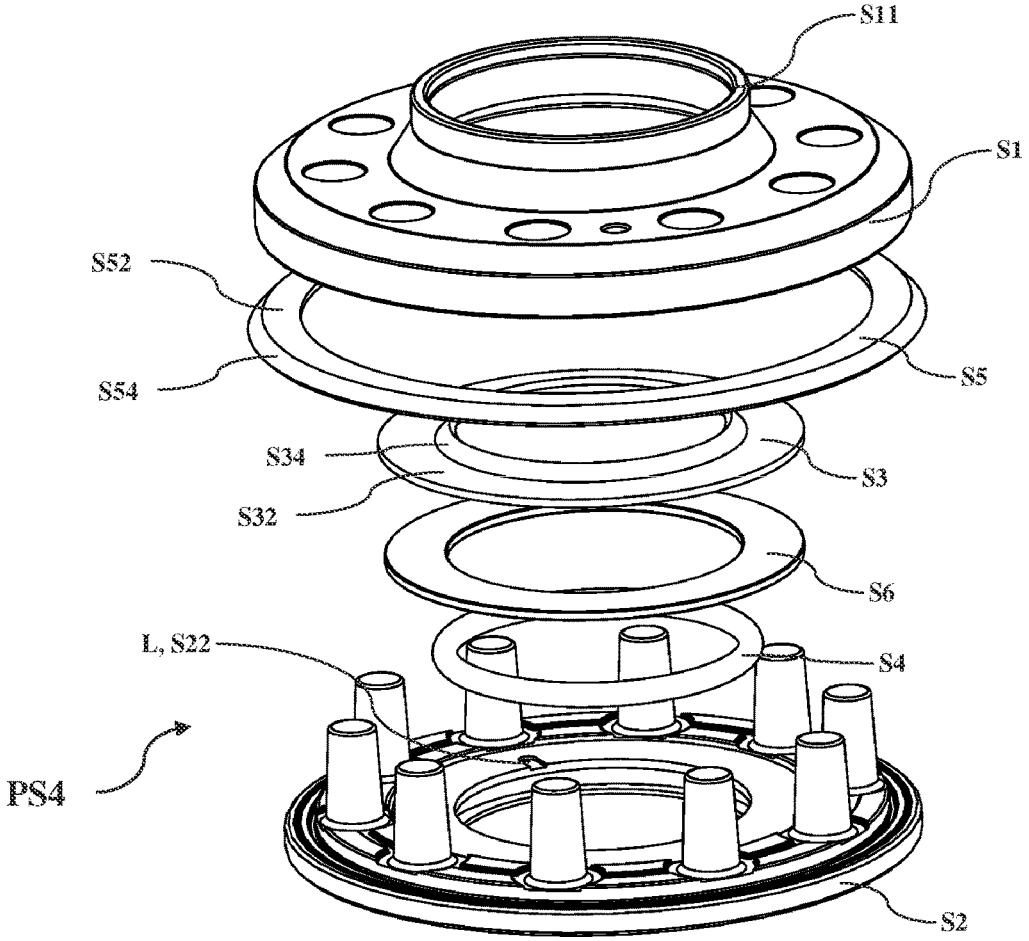
FIG. 6B is an exploded view of the seal assembly shown in FIG. 6A.

A seal assembly PS4 according to a fourth embodiment of the present application is described in detail hereinafter with reference to FIGS. 6A and 6B. The seal assembly PS4 according to the fourth embodiment is different from the seal assembly PS1 according to the first embodiment in that, the second seal member S4 is configured to prevent the fluid from flowing from the back pressure chamber BC to the high-pressure side, and prevent the fluid from flowing from the high-pressure side to the back pressure chamber BC, for example, the second seal member S4 may be an O-shaped ring arranged or supported in the lower plate S2; and a channel S22 is formed in the lower plate S2 such as to allow the fluid in the back pressure chamber to enter into a space between the first seal member S3 and the second seal member S4. For example, the channel S22 may be an L-shaped hole which is opened at one end in a bottom surface of the lower plate S2 and is opened at the other end in a side surface of the lower plate S2. The seal assembly according to the fourth embodiment may achieve the similar effect as that of the first embodiment.

Figure 7A:
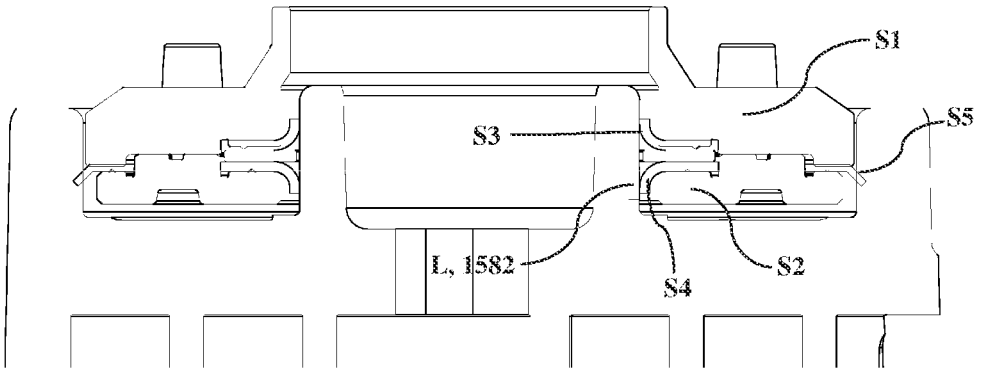
FIG. 7A is a sectional view of a fifth embodiment of the present application.
Figure 7B:
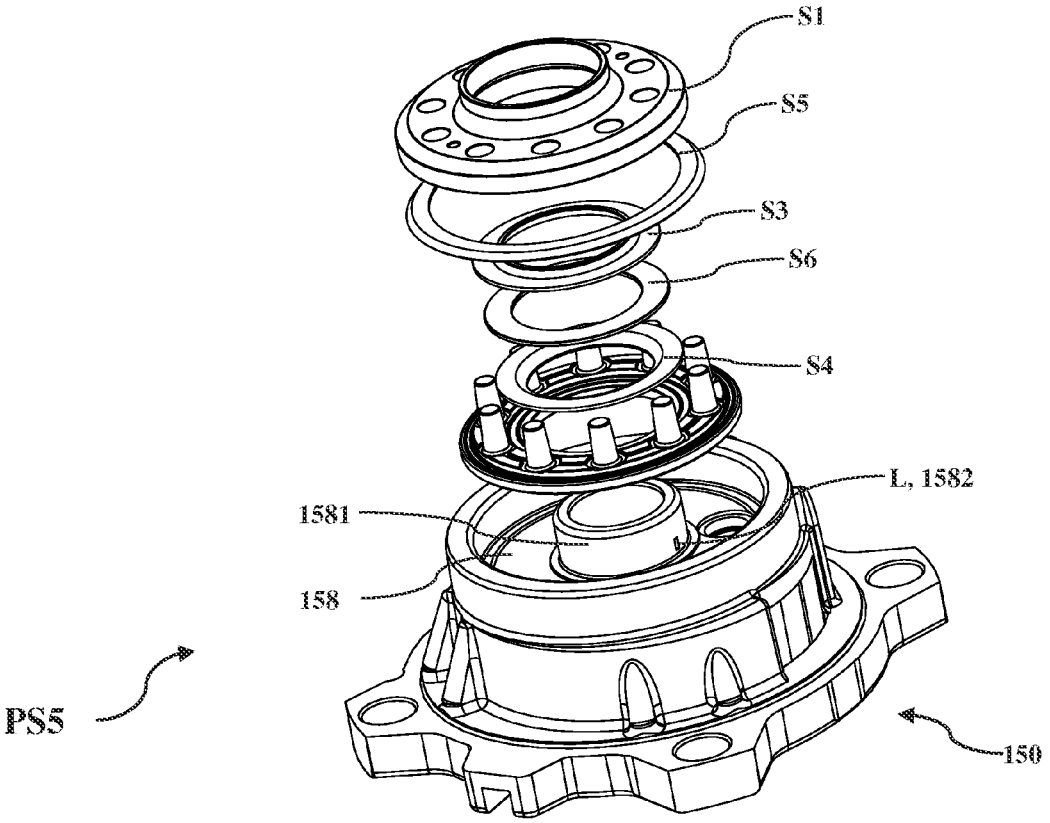
FIG. 7B is an exploded view of the assembly shown in FIG. 7A.

A seal assembly PS5 according to a fifth embodiment of the present application is described in detail hereinafter with reference to FIGS. 7A and 7B. The seal assembly PS5 according to the fifth embodiment may be implemented by a double-layer seal assembly shown in FIGS. 2A and 2B. However, in the fifth embodiment, the leakage channel L may be formed in a radial inner side wall 1581 of the concave portion 158. More specifically, the leakage channel L may be configured as a groove 1582 formed in the radial inner side wall 1581 of the concave portion 158 at a position corresponding to the second seal member S4. Preferably, the groove 1582 does not extend to the position of the first seal member S3. The fifth embodiment may achieve the similar effect as that of the first embodiment. In addition, in the fifth embodiment, the seal assembly is not required to be machined, or only the non-orbiting scroll component 150 is required to be slightly machined, which can also save the overall manufacture cost of the compressor.

Figure 8A:
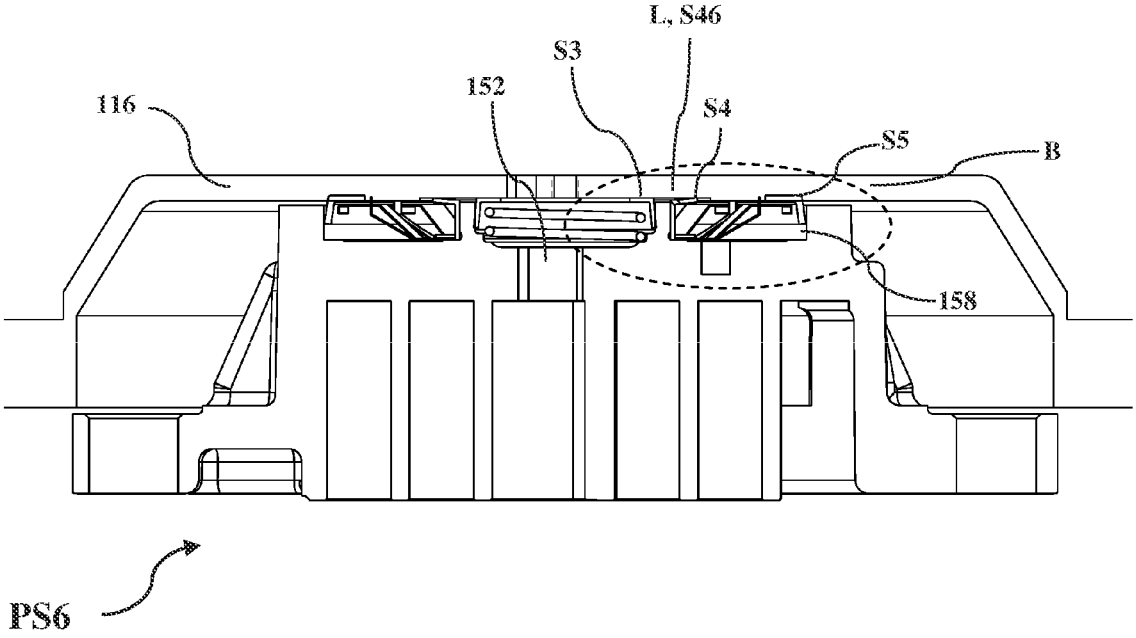
FIG. 8A is a sectional view of a seal assembly according to a sixth embodiment of the present application.
Figure 8B:
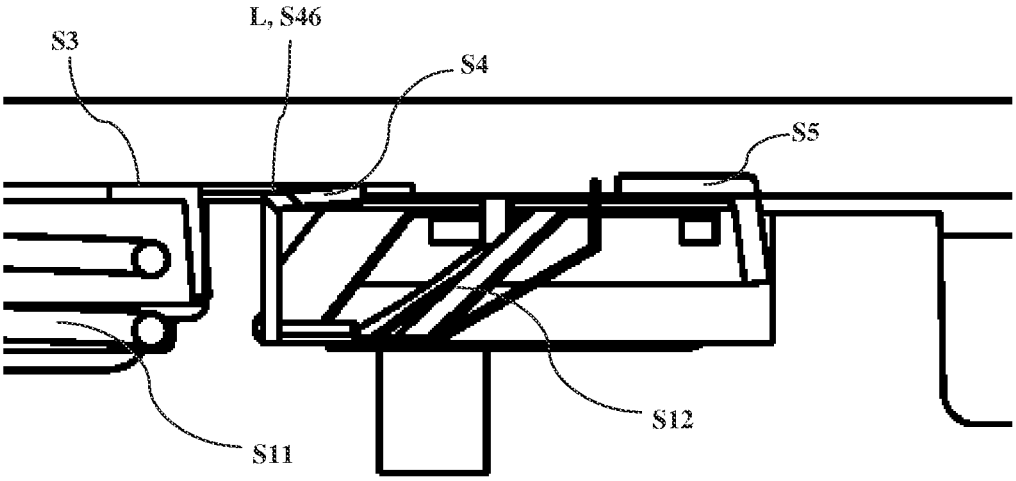
FIG. 8B is a partially enlarged view of part B in FIG. 8A.

A seal assembly PS6 according to a sixth embodiment of the present application is described in detail hereinafter with reference to FIGS. 8A and 8B. The seal assembly PS6 according to the sixth embodiment may include: a first seal member S3 arranged about the discharge port 152 of the non-orbiting scroll component 150 to prevent the fluid from flowing from the high-pressure side to the back pressure chamber BC, however, allow the fluid to flow from the back pressure chamber BC to the high-pressure side; and a second seal member S4 arranged in the concave portion 158 to prevent the fluid from flowing from the back pressure chamber BC to the high-pressure side, however, allow the fluid to flow from the high-pressure side to the back pressure chamber BC. The seal assembly PS6 may further include a third seal member S5 arranged in the concave portion 158 to prevent the fluid from flowing from the back pressure chamber BC to the low-pressure side. More specifically, these seal members S3, S4 and S5 may have a substantially annular shape, and have a substantially L-shaped cross section, and two arms of the L-shaped cross section respectively abut against a wall surface of the non-orbiting scroll component 150 and the separator 116 to achieve the sealing. The first seal member S3 may be supported by a spring S11 arranged about the discharge port 152. The second seal member S4 and the third seal member S5 may be supported by a spring S12 arranged in the concave portion 158. It is to be noted that, the construction of the seal assembly shown in the sixth embodiment is described in detail in China Invention Patent CN 202228358, the entire disclosure of which is incorporated herein by reference.

In the sixth embodiment, the leakage channel L is configured to be a through hole or slot S46 formed in the second seal member S4. The sixth embodiment may achieve the similar effect as that of the first embodiment.

While various embodiments and modifications of the present application have been described in detail above, it should be understood by those skilled in the art that the present application is not limited to the specific embodiments and modifications described hereinbefore, but may include other various possible combinations and groups.

For example, a scroll compressor is provided according to one aspect of the present application. The scroll compressor includes an orbiting scroll component, a non-orbiting scroll component, a seal assembly, and a leakage channel. The orbiting scroll component includes an orbiting scroll end plate and a spiral orbiting scroll vane formed at one side of the orbiting scroll end plate. The non-orbiting scroll component includes a non-orbiting scroll end plate, a spiral non-orbiting scroll vane formed at one side of the non-orbiting scroll end plate, and a concave portion formed at the other side of the non-orbiting scroll end plate. The concave portion is in fluid communication with one of a series of compression chambers formed between the orbiting scroll vane and the non-orbiting scroll vane via a medium pressure channel. The seal assembly is fitted with the concave portion to jointly form a back pressure chamber, and is configured to separate the back pressure chamber from a high-pressure side and a low-pressure side in the scroll compressor. The leakage channel is configured to allow fluid in the back pressure chamber to leak.

According to a second aspect of the present application, the leakage channel may be configured to allow the fluid in the back pressure chamber to leak to the high-pressure side.

According to a third aspect of the present application, the leakage channel may be formed in the seal assembly.

According to a fourth aspect of the present application, the seal assembly may be arranged in the concave portion, and the seal assembly may include: a first seal member configured to prevent the fluid at the high-pressure side from flowing to the back pressure chamber, however, allow the fluid to flow from the back pressure chamber to the high-pressure side; and a second seal member configured to prevent the fluid in the back pressure chamber from flowing to the high-pressure side, however, allow the fluid to flow from the high-pressure side to the back pressure chamber.

According to a fifth aspect of the present application, the leakage channel may be formed in the second seal member.

According to a sixth aspect of the present application, the second seal member may include a substantially annular body and a seal lip extending from the body towards the non-orbiting scroll end plate and abutting against a radial inner side wall of the concave portion, and the leakage channel is formed in the seal lip of the second seal member.

According to a seventh aspect of the present application, the leakage channel may be a through hole formed in the seal lip of the second seal member.

According to an eighth aspect of the present application, the leakage channel may be a cutout formed on an edge of the seal lip of the second seal member.

According to a ninth aspect of the present application, the leakage channel may be a through hole formed in the body or the seal lip of the second seal member.

According to a tenth aspect of the present application, the seal assembly may further include an intermediate plate arranged between the first seal member and the second seal member, and a cutout is formed in the intermediate plate at a position corresponding to the through hole.

According to an eleventh aspect of the present application, the seal assembly may be arranged in the concave portion, and the seal assembly may include: a first seal member configured to prevent the fluid at the high-pressure side from flowing to the back pressure chamber, however, allow the fluid to flow from the back pressure chamber to the high-pressure side; and a second seal member configured to prevent the fluid in the back pressure chamber from flowing to the high-pressure side, and prevent the fluid at the high-pressure side from flowing to the back pressure chamber.

According to a twelfth aspect of the present application, the second seal member may be an O-shaped ring.

According to a thirteenth aspect of the present application, the seal assembly may include a lower plate configured to support the second seal member, and a channel may be formed in the lower plate to allow the fluid in the back pressure chamber to enter into a space between the first seal member and the second seal member.

According to a fourteenth aspect of the present application, the leakage channel may be formed in a radial inner side wall of the concave portion.

According to a fifteenth aspect of the present application, the seal assembly may be arranged in the concave portion, the seal assembly may include: a first seal member configured to prevent the fluid at the high-pressure side from flowing to the back pressure chamber, however, allow the fluid to flow from the back pressure chamber to the high-pressure side; and a second seal member configured to prevent the fluid in the back pressure chamber from flowing to the high-pressure side, however, allow the fluid to flow from the high-pressure side to the back pressure chamber, and the leakage channel is configured as a groove formed in the radial inner side wall of the concave portion at a position corresponding to the second seal member.

According to a sixteenth aspect of the present application, the groove does not extend to reach the first seal member.

According to a seventeenth aspect of the present application, the seal assembly may include: a first seal member arranged about the discharge port of the non-orbiting scroll component to prevent the fluid at the high-pressure side from flowing to the back pressure chamber, however, allow the fluid to flow from the back pressure chamber to the high-pressure side; and a second seal member arranged in the concave portion to prevent the fluid in the back pressure chamber from flowing to the high-pressure side, however, allow the fluid to flow from the high-pressure side to the back pressure chamber.

According to an eighteenth aspect of the present application, the leakage channel may be configured to be a through hole or slot formed in the second seal member.

According to an eighteenth aspect of the present application, the seal assembly may further include a third seal member arranged in the concave portion to prevent the fluid in the back pressure chamber from flowing to the low-pressure side.

According to a nineteenth aspect of the present application, the seal assembly may further include a third seal member configured to prevent the fluid in the back pressure chamber from flowing to the low-pressure side.

According to a twentieth aspect of the present application, the third seal member may include a substantially annular body and a seal lip extending towards the non-orbiting scroll end plate from the body and abutting against a radial outer side wall of the concave portion.

According to a twenty-second aspect of the present application, the scroll compressor may further include a separator configured to separate an inner space of the scroll compressor into a high-pressure side and a low-pressure side, wherein the seal assembly is arranged between the separator and the non-orbiting scroll component.

According to a twenty-third aspect of the present application, the minimum cross-sectional area of the leakage channel may be ½ to 3 times as big as the minimum cross-sectional area of the medium pressure channel.

According to a twenty-fourth aspect of the present application, the minimum cross-sectional area of the leakage channel may be set to be smaller than the minimum cross-sectional area of the medium pressure channel.

According to a twenty-fifth aspect of the present application, the minimum cross-sectional area of the leakage channel is set to be 0.8 times to 1.2 times as big as the minimum cross-sectional area of the medium pressure channel.

While various embodiments of the present application have been described in detail herein, it should be understood that the present application is not limited to the specific embodiments described in detail and illustrated herein, and those skilled in the art can also make other variants and modifications without departing from the principle and scope of the application, and these variants and modifications should also be deemed to fall into the protective scope of the application. Furthermore, all the elements described herein can be replaced by other technically equivalent elements.

What is claimed is:

1. A scroll compressor, comprising:

an orbiting scroll component, wherein the orbiting scroll component comprises an orbiting scroll end plate, and a spiral orbiting scroll vane formed at one side of the orbiting scroll end plate;

a non-orbiting scroll component, wherein the non-orbiting scroll component comprises a non-orbiting scroll end plate, a spiral non-orbiting scroll vane formed at one side of the non-orbiting scroll end plate, and a concave portion formed at the other side of the non-orbiting scroll end plate, and wherein the concave portion is in fluid communication with one of a series of compression chambers formed between the orbiting scroll vane and the non-orbiting scroll vane via a medium pressure channel;

a seal assembly, wherein the seal assembly is fitted with the concave portion to jointly form a back pressure chamber, and wherein the seal assembly is configured to separate the back pressure chamber from a high-pressure side and a low-pressure side in the scroll compressor; and a leakage channel configured to allow fluid in the back pressure chamber to leak to the high-pressure side, wherein the seal assembly comprises: a first seal member configured to prevent the fluid at the high-pressure side from flowing to the back pressure chamber but allow the fluid in the back pressure chamber to flow to the high-pressure side; and a second seal member configured to prevent the fluid in the back pressure chamber from flowing to the high-pressure side but allow the fluid at the high-pressure side to flow to the back pressure chamber, and the leakage channel is formed in the second seal member.

2. The scroll compressor according to claim 1, wherein the seal assembly is arranged in the concave portion.

3. The scroll compressor according to claim 1, wherein the second seal member comprises a substantially annular body and a seal lip extending from the body towards the non-orbiting scroll end plate and abutting against a radial inner side wall of the concave portion, and the leakage channel is formed in the body or the seal lip of the second seal member.

4. The scroll compressor according to claim 3, wherein the leakage channel is a cutout formed on an edge of the seal lip of the second seal member.

5. The scroll compressor according to claim 3, wherein the leakage channel is a through hole formed in the body or the seal lip of the second seal member.

6. The scroll compressor according to claim 5, wherein the seal assembly further comprises an intermediate plate arranged between the first seal member and the second seal member, and a cutout is formed in the intermediate plate at a position corresponding to the through hole.

7. The scroll compressor according to claim 1, wherein the first seal member arranged about the discharge port of the non-orbiting scroll component.

8. The scroll compressor according to claim 7, wherein the leakage channel is configured to be a through hole or slot formed in the second seal member.

9. The scroll compressor according to claim 8, wherein the seal assembly further comprises a third seal member arranged in the 4 concave portion to prevent the fluid in the back pressure chamber from flowing to the low-pressure side.

10. The scroll compressor according to claim 1, wherein the seal assembly further comprises a third seal member configured to prevent the fluid in the back pressure chamber from flowing to the low-pressure side.

11. The scroll compressor according to claim 10, wherein the third seal member comprises a substantially annular body and a seal lip extending towards the non-orbiting scroll end plate from the body and abutting against a radial outer side wall of the concave portion.

12. The scroll compressor according to claim 1, further comprising a separator configured to separate an inner space of the scroll compressor into the high-pressure side and the low-pressure side, wherein the seal assembly is arranged between the separator and the non-orbiting scroll component.

13. The scroll compressor according to claim 1, wherein a minimum cross-sectional area of the leakage channel is ½ to 3 times as large as the minimum cross-sectional area of the medium pressure channel.

14. The scroll compressor according to claim 13, wherein the minimum cross-sectional area of the leakage channel is set to be smaller than the minimum cross-sectional area of the medium pressure channel.

15. The scroll compressor according to claim 13, wherein the minimum cross-sectional area of the leakage channel is set to be 0.8 times to 1.2 times as large as the minimum cross-sectional area of the medium pressure channel.

16. A scroll compressor comprising:

an orbiting scroll component, wherein the orbiting scroll component comprises an orbiting scroll end plate, and a spiral orbiting scroll vane formed at one side of the orbiting scroll end plate;

a non-orbiting scroll component, wherein the non-orbiting scroll component comprises a non-orbiting scroll end plate, a spiral non-orbiting scroll vane formed at one side of the non-orbiting scroll end plate, and a concave portion formed at the other side of the non-orbiting scroll end plate, and wherein the concave portion is in fluid communication with one of a series of compression chambers formed between the orbiting scroll vane and the non-orbiting scroll vane via a medium pressure channel;

a seal assembly, wherein the seal assembly is fitted with the concave portion to jointly form a back pressure chamber, and wherein the seal assembly is configured to separate the back pressure chamber from a high-pressure side and a low-pressure side in the scroll compressor; and a leakage channel configured to allow fluid in the back pressure chamber to leak to the high-pressure side, wherein the seal assembly is arranged in the concave portion, and the seal assembly comprises: a first seal member configured to prevent the fluid at the high-pressure side from flowing to the back pressure chamber but allow the fluid in the back pressure chamber to flow to the high-pressure side; and a second seal member configured to prevent the fluid in the back pressure chamber from flowing to the high-pressure side and prevent the fluid at the high-pressure side from flowing to the back pressure chamber, the seal assembly comprises a lower plate configured to support the second seal member, and the leakage channel comprises a channel formed in the lower plate such as to allow the fluid in the back pressure chamber to enter into a space between the first seal member and the second seal member.

17. The scroll compressor according to claim 16, wherein the second seal member is an O-shaped ring.

18. A scroll compressor comprising:

an orbiting scroll component, wherein the orbiting scroll component comprises an orbiting scroll end plate, and a spiral orbiting scroll vane formed at one side of the orbiting scroll end plate;

a non-orbiting scroll component, wherein the non-orbiting scroll component comprises a non-orbiting scroll end plate, a spiral non-orbiting scroll vane formed at one side of the non-orbiting scroll end plate, and a concave portion formed at the other side of the non-orbiting scroll end plate, and wherein the concave portion is in fluid communication with one of a series of compression chambers formed between the orbiting scroll vane and the non-orbiting scroll vane via a medium pressure channel;

a seal assembly, wherein the seal assembly is fitted with the concave portion to jointly form a back pressure chamber, and wherein the seal assembly is configured to separate the back pressure chamber from a high-pressure side and a low-pressure side in the scroll compressor; and a leakage channel configured to allow fluid in the back pressure chamber to leak to the high-pressure side, wherein the seal assembly is arranged in the concave portion, the seal assembly comprises: a first seal member configured to prevent the fluid at the high-pressure side from flowing to the back pressure chamber but allow the fluid in the back pressure chamber to flow to the high-pressure side; and a second seal member configured to prevent the fluid in the back pressure chamber from flowing to the high-pressure side but allow the fluid at the high-pressure side to flow to the back pressure chamber, the leakage channel is configured as a groove formed in a radial inner side wall of the concave portion at a position corresponding to the second seal member, and the groove does not extend to reach the first seal member.

* * * * *